United States Patent [19]

Uchiya et al.

[11] 4,440,552

[45] Apr. 3, 1984

[54] ELECTROSTATIC PARTICLE PRECIPITATOR

[75] Inventors: Tsuneo Uchiya, Abiko; Hiroaki Yabuta, Toride; Seizi Hikizi, Iruma, all of Japan

[73] Assignee: Hitachi Plant Engineering & Construction Co., Ltd., Tokyo, Japan

[21] Appl. No.: 405,872

[22] Filed: Aug. 6, 1982

Related U.S. Application Data

[63] Continuation of Ser. No. 240,609, Mar. 5, 1981, abandoned.

[30] Foreign Application Priority Data

| | | | |
|---|---|---|---|
| Mar. 6, 1980 | [JP] | Japan | 55-27368 |
| Mar. 6, 1980 | [JP] | Japan | 55-27369 |
| Mar. 6, 1980 | [JP] | Japan | 55-28272 |
| Mar. 6, 1980 | [JP] | Japan | 55-27367 |
| Aug. 6, 1980 | [JP] | Japan | 55-107118 |

[51] Int. Cl.[3] ..... B03B 3/10; B03B 3/36; B03B 3/74

[52] U.S. Cl. ..... 55/114; 55/121; 55/129; 55/138; 55/149

[58] Field of Search ..... 55/14, 106, 109, 113, 55/114, 121, 128, 129, 136, 138, 149, 156, 351, 353

[56] References Cited

U.S. PATENT DOCUMENTS

| | | | |
|---|---|---|---|
| 2,061,045 | 11/1936 | Rüder et al. | 55/136 |
| 3,375,638 | 4/1968 | Dungler | 55/149 |
| 3,701,236 | 10/1972 | Rotsky et al. | 55/114 |
| 3,733,785 | 5/1973 | Gallaer | 55/129 |
| 3,912,467 | 10/1975 | Trump et al. | 55/114 |

FOREIGN PATENT DOCUMENTS

| | | | |
|---|---|---|---|
| 1001973 | 2/1957 | Fed. Rep. of Germany | 55/149 |
| 2360483 | 6/1975 | Fed. Rep. of Germany | 55/106 |
| 377788 | 7/1964 | Switzerland | 55/14 |

*Primary Examiner*—David L. Lacey
*Attorney, Agent, or Firm*—Pennie & Edmonds

[57] ABSTRACT

An electrostatic particle precipitator for removing dust particles from a flue gas. The precipitator includes a plurality of collecting electrodes in the shape of plates mounted on endless chains and moving between a first region through which flue gas to be treated flows and a second region where the flow of gas is extremely scarce. A dust removal mechanism is positioned in the second region to remove dust which accumulates on the electrode plates. The moving speed of the collecting electrodes is controlled within a certain range to maintain a prescribed thickness of dust on the electrodes whereby the ocurrence of reverse ionization phenomenon is prevented.

9 Claims, 12 Drawing Figures

FIG. 4-A
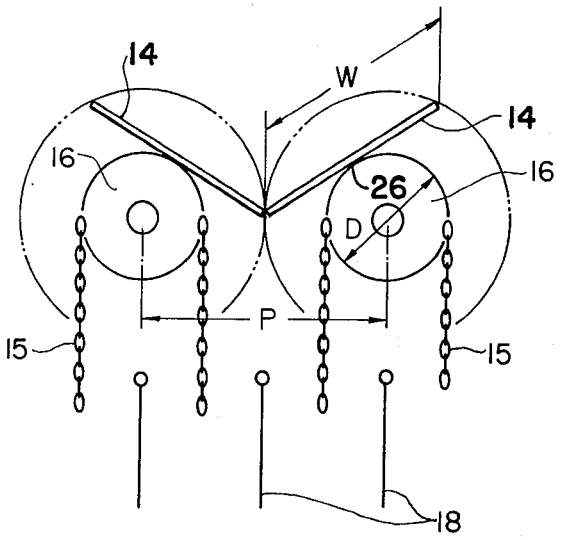
FIG. 4-B
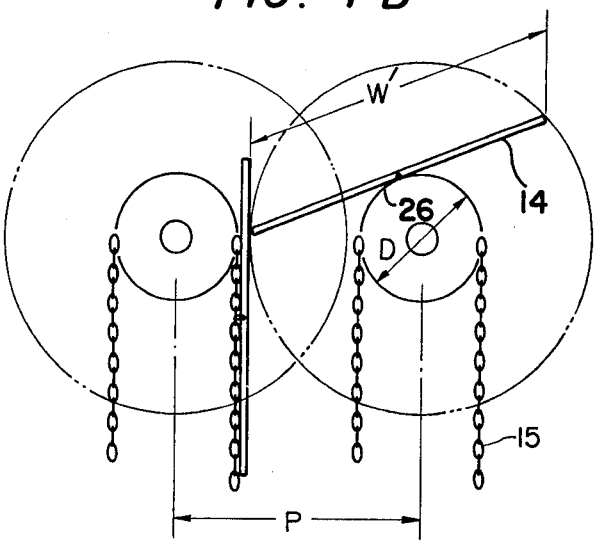

FIG. 5-A
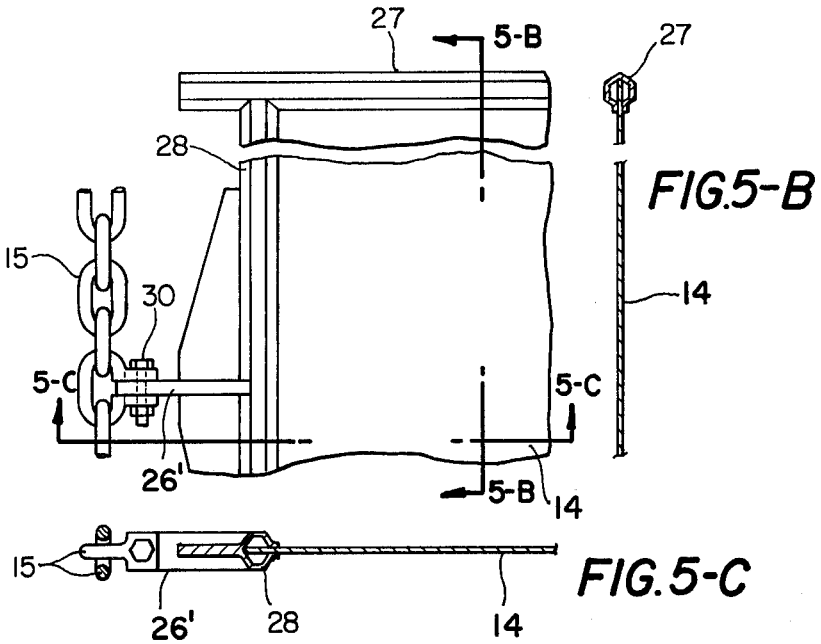
FIG. 6
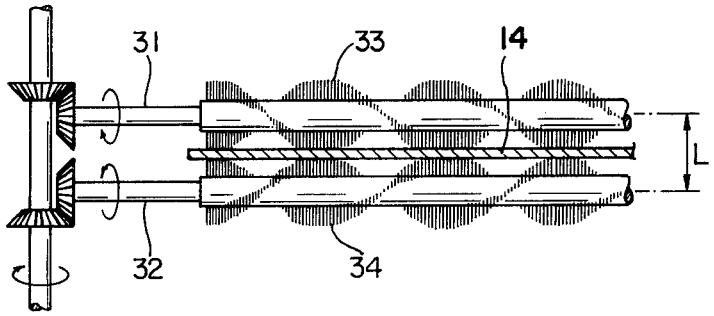

ELECTROSTATIC PARTICLE PRECIPITATOR

CROSS-REFERENCE TO RELATED APPLICATION

The application is a continuation of application Ser. No. 240,609, filed Mar. 5, 1981, now abandoned.

BACKGROUND OF THE INVENTION

The present invention relates to electrostatic particle precipitators which are capable of removing with a high collecting efficiency dust particles that are difficult to collect.

The flue gas discharged from all types of boilers for business and industrial purposes, cement calcining furnaces and metallurgic sintering furnaces involve a great amount of dust particles. To remove these particles fabric filters, cyclones or electrostatic particle precipitators are being used. However, as regulations on the allowable number of dust particles in the flue gas are becoming stricter and as attempts are made for attaining such regulated allowable values without fail with the least energy and over an extended period of time, it is almost impossible to accomplish the purpose with conventional devices. For example, the dust particles contained in the flue gas from coal-burning boilers in the order of several scores g/m$^3$N can be reduced to somewhere around several thousand mg/m$^3$N by channelling the flue gas through a cyclone and can be further reduced to around 50–100 mg/m$^3$N by treating it with an electrostatic particle precipitator. However, for reducing the contained dust particles further, e.g., to less than 20–30 mg/m$^3$N, an injection of ammonia gas or spraying of water has been used, but with a success only in laboratory. There has been no instance of industrial success where economics, prevention of secondary pollution and the safety in operation are taken into consideration.

In order to improve the collecting efficiency of the electric particle precipitator, it has been suggested that a device be used to remove the dust particles accumulated on the electrodes by moving the collecting electrodes to a region which is free from the impact of the flue gas stream. See, for example, U.S. Pat. No. 3,912,467 (Oct. 4, 1975).

FIG. 1 of the present application shows the collecting electrode moving system used in the electrostatic particle precipitator disclosed in said U.S. Pat. No. 3,912,467. In the drawing, 1 is the collecting electrode moving system arranged in a plural number in parallel runs. On the main driving wheels 2 and the subject driving wheels 3, endless chains 5 are disposed. Only the wheels and the chain on the left side of the device are shown in FIG. 1. A plurality of the collecting plate electrodes 4 are arranged on the chains. They are vertically rectangular in their shape and are mounted in series with a fixed distance between each other. Discharge electrodes 6 are positioned in between each of the arrays of moving collecting plate electrodes. The treating flue gas flows from the left to right (as viewed in FIG. 1) toward the rear of the system.

In this structure, by applying a high voltage between the discharge electrodes 6 and the collecting plate electrodes 4, the space in which the discharge electrodes 6 are located forms a dust collecting region and the dust particles contained in the flue gas are collected on the surface of the collecting plate electrodes 4. The lower space where no discharge electrodes 6 exists is the region where no dust is collected on the electrodes 4. In this region the dust particles accumulated on the surface of the electrodes 4 are scraped off by a removing device 7.

In practice, this type of electrostatic particle precipitator comprises a long track formed by a pair of endless chains 5 running around a plurality of bends as dictated by the number of wheels 3. This results in a complex structure and one which is inconvenient in that its overall dimension is large as compared with the fixed type particle precipitator. In addition, generally the ingredients of the dust particles contained in the flue gas discharged from such furnaces as boilers involve silica and alumina which make the structural steel materials vulnerable to wear. Also, the conventional electrode moving type electrostatic particle precipitator as described above requires that a large tension be applied to the endless chains 5. This is so because of the long length of the chains 5 and the number of wheels 3. Since the wear-rendering dust particles become attached to these chains, they and the subject driving wheels 3 are particularly subject to excessive wear damage. This wear can occur in a short period of time. It is therefore difficult to maintain a stabilized dust collecting operation over a long period of time in situations involving wear-rendering dust particles.

SUMMARY OF THE INVENTION

One of the objectives of the present invention is to provide an electrostatic particle precipitator that is equipped with moving collecting electrodes which are capable of efficiently removing dust particles from flue gas, which particles have a high electric resistance or extra-fine particle size on the order of submicron size. One other objective of the present invention is to provide an electrostatic particle precipitator that has a simple compact structure. Another objective of the present invention is to provide an electrostatic particle precipitator that is capable of coping with varying dust concentration and of exhibiting a high performance over a long period of time.

In order to accomplish these objectives, the apparatus of the present invention includes an array of collecting electrodes which move back and forth between the region where the dust particles are collected and a non particle collecting region where the dust particles are removed from the collecting electrodes. Discharge electrodes face against the collecting electrodes and generate a corona current in the intervening space. The means for moving the collecting electrodes between the two regions includes a pair of main driving wheels, a pair of subject driving wheels and a pair of endless chains connected between the main driving wheels and the subject driving wheels to form a loop comprised of a pair of tracks or rows. The tracks extend parallel to each other with no bend except for the bends at the ends of the loop, i.e., at the main driving wheels and the subject driving wheels. A plurality of these collecting arrays, each made up of two tracks or rows, are disposed in side by side relationship.

Furthermore, the apparatus of the present invention is structured so as to keep the layer thickness of the dust particles on the collecting electrodes between proscribed limits. This is done by controlling the moving speed of the collecting electrodes. In addition, to make the whole system as compact as possible, the distance between the arrays of collecting electrodes is kept narrow. However, if the distance between each array is narrowed too much, a plate electrode on one array will hit a plate electrode in the neighboring array at the point where the plate electrodes make a U-turn. To avoid this, the neighboring arrays of collecting electrodes are constructed and arranged to make a synchronized movement with a fixed phase difference to each other.

The present invention is described hereinafter mainly with respect to its application to the removal of so-called fly ash dust particles that are contained in the flue gas from coal-burning boilers. These particles are extremely difficult to remove by the conventional electrostatic particle precipitators. The present invention is of course also applicable to those dust particles that are easier to remove.

About 50–90 wt % of the dust particles which are called fly ash and are contained in the flue gas from coal-burning boilers is comprised of such minerals as silica and alumina. The electric resistance of these minerals is as high as $10^{12-15}\Omega$cm (150° C.) while their particle sizes are distributed over a wide range of under 1 μm to several score μm. Such high electrically resistive dust particles have varying degrees of ionization in the space of the corona electric field. They also differ in the location where they accumulate on the electrodes depending upon their particle sizes. Generally, the particles of larger size are easily collectible and accumulate on the electrodes close to the inlet of the gas to the collecting system, whereas the particles of submicron size are difficult to collect and precipitate on the electrodes close to the outlet of the system. Also the cohesive attraction of small particles to the surface of the electrodes derives from the electrostatic force generated by the electric charge each particle has. This cohesive attraction increases in proportion to the layer thickness of accumulated dust within the scope of less than several hundreds μm. With a layer thickness under around 100 μm, a complete removal of the particles can be made by a simple brushing. Once the layer thickness exceeds a certain fixed value, however, and the electric intensity gradient in the accumulated layer reaches about 10 kV/cm or over, the generation of a reverse ionization zone makes particle accumulation on the electrodes difficult. In other words once the reverse ionization zone is created naturally the particle collecting performance of the system deteriorates. Therefore, in the case of collecting dust particles involving high electric resistivity, the accumulated particles need to be removed from the collecting electrodes before creation of an electric intensity gradient which may permit any reverse ionization zone to appear.

An experimental electrostatic particle precipitator which is suitable for practical use and facilitates easy removal of dust was constructed with due consideration being given to preventing the development of any reverse ionization zone. The test result thereof has led to the finding that if the dust removal from the electrodes is performed at the point when the layer thickness of the accumulated dust is under 100 μm, preferably within the range of 20–60 μm, the removal of dust contained in flue gas can be accomplished with a very high efficiency.

The present invention also includes a particle collecting system that provides in its front or upstream part a fixed type electrostatic particle precipitator for removing the dust from fixed electrodes by a rapping method. In the rear or downstream part of the system, on the other hand, there is provided an electrostatic particle precipitator equipped with arrays of moving collecting electrodes.

BRIEF DESCRIPTION OF THE DRAWINGS

In the drawings:

FIG. 4-A is a side view exemplifying the width (W) of a collecting plate electrode where the relative positions of two neighboring collecting plate electrodes are not taken into consideration;

FIG. 4-B is a side view exemplifying the width (W') of the collecting plate electrode where the relative positions of the two neighboring collecting plate electrodes are taken into consideration;

FIG. 5A is a detailed view showing the end of the particle collecting electrode used in the electrostatic particle precipitator shown in FIG. 2;

FIG. 5B is a cross-sectional view taken along lines 5B—5B of FIG. 5A;

FIG. 5C is a cross-sectional view taken along lines 5C—5C of FIG. 5A;

FIG. 6 is a top view of one example of the dust removing brushes of the dust particle remover used in the electrostatic particle precipitator shown in FIG. 2;

DESCRIPTION OF PREFERRED EMBODIMENTS

Figure 1:
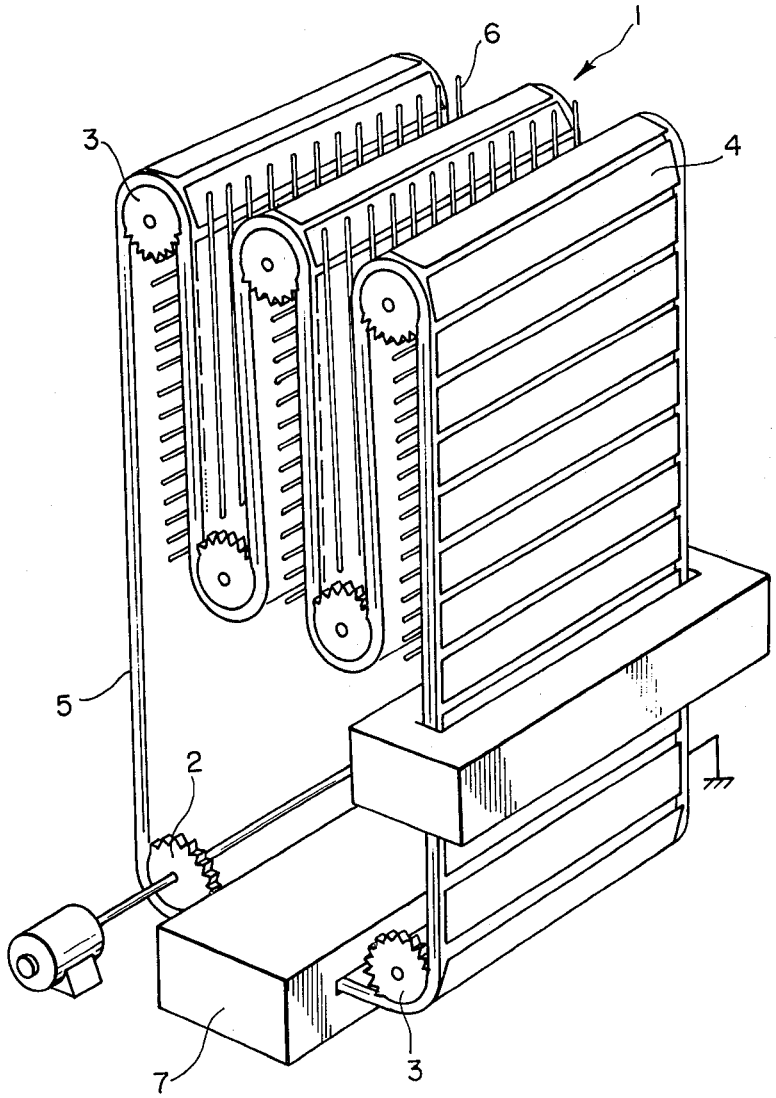
FIG. 1 PRIOR ART
FIG. 1 is a perspective view of the electrode part of the conventional moving electrode type electrostatic particle precipitator.
Figure 2:
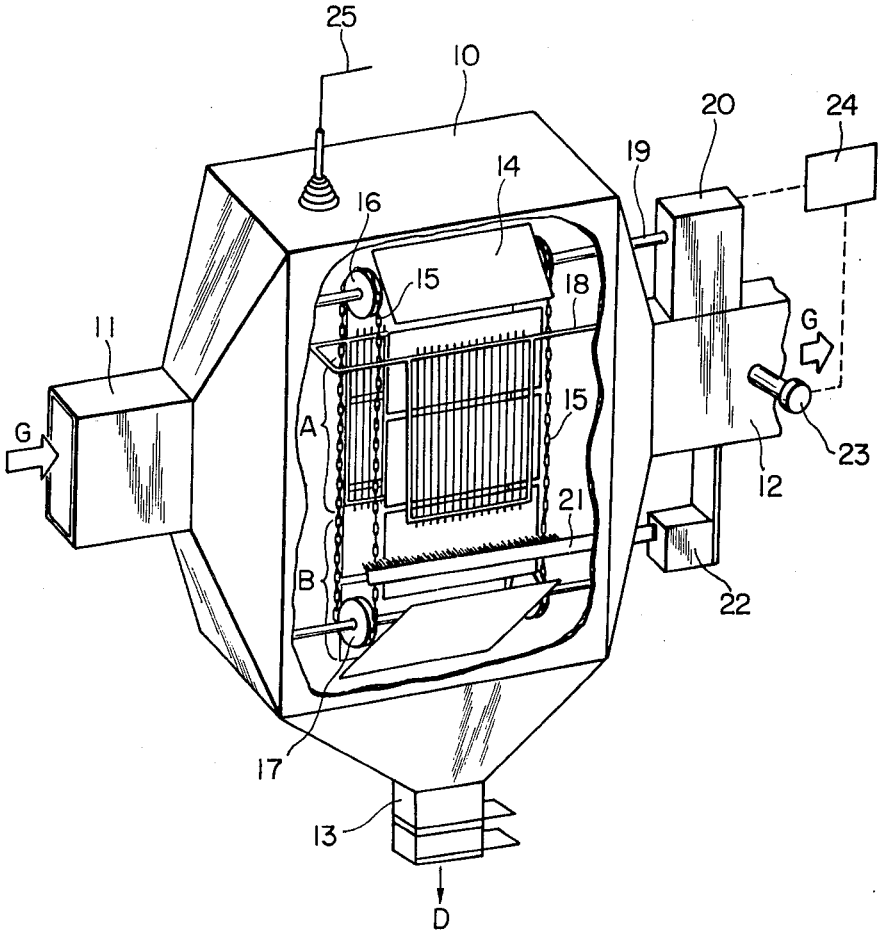
FIG. 2 is a schematic view of the electrostatic particle precipitator of the present invention.

As shown in FIG. 2, the electrostatic particle precipitator with the moving electrodes of the present invention includes a casing 10 having a gas inlet duct 11 and a gas outlet duct 12. The flue gas to be treated flows from left to right in FIG. 2. The dust collected in the precipitator is discharged via a hopper 13 installed at the bottom of the casing 10. The particle collecting electrodes include a plurality of plate electrodes 14, each in the shape of rectangular plate with opposite ends mounted on endless chains 15. The chains, in turn, move in a circular path or loop between upper driving pulleys, i.e., main driving wheels 16, and lower pulleys, i.e., subject driving wheels 17. Discharge electrodes 18 in the shape of stockades are placed in position opposing the collecting electrodes 14. The discharge electrodes 18 are rigidly fixed in the system. The main driving wheels 16 are connected to a variable driving means 20 by way of a shaft 19.

The particle collecting occurs in the region A where the discharge electrodes 18 and the collecting electrodes 14 oppose each other. This region is called the collecting region. On the other hand, the region B which is located below region A is called the non-collecting region. Here the impact of the treating flue gas stream is less.

A dust removing device 21 is located in the non-collecting region B. This device operates to remove dust particles accumulated on the collecting electrodes 14. The dust removing device 21 is supported by the holder 22, and is given faint vibration. Its pressing force against the collecting electrodes is adjusted by the holder 22.

The gas outlet duct 12 is provided with a dust monitor 23. The electric signals from the dust monitor are put into a comparative adjustor 24, the output of which controls the variable driving means 20. Finally, the discharge electrodes 18 are connected to the high voltage power source by way of a bus 25 and the collecting electrodes 14 are connected to a grounding electrode.

Particle collecting tests were performed with the precipitator shown in FIG. 2. The dust concentration of the inlet flue gas were fixed at 100 mg/m$^3$N, for two kinds of dust, one having an electrical resistance of 1–2 x $10^8\Omega$cm and another having $1\text{–}5\times10^{13}\Omega$cm electrical resistance. The dust concentration in the outlet flue gas was measured for average layer thicknesses of accumulated dust at the point of removal of 40 $\mu$m, 90 $\mu$m and 160 $\mu$m. The layer thickness of accumulated dust was varied by changing the speed of movement of the collecting electrode 14 through the region A. The voltage applied to the discharge electrodes 18 was 50 kV and the discharge current on the collecting electrode 14 was 1 mA/m$^2$.

TABLE 1

| Test No. | Electric Resistance of Dust ($\Omega$cm) | Thickness of Dust Accumulation at the Point of Removal ($\mu$m) | Dust Concentration of Outlet Gas (mg/m$^3$N) |
|---|---|---|---|
| 1 | $1\text{–}2\times10^8$ | 40 ± 5 | 10 |
| 2 | $1\text{–}2\times10^8$ | 90 ± 10 | 12 |
| 3 | $1\text{–}2\times10^8$ | 160 ± 10 | 9 |
| 4 | $1\text{–}5\times10^{13}$ | 40 ± 5 | 12 |
| 5 | $1\text{–}5\times10^{13}$ | 90 ± 10 | 26 |
| 6 | $1\text{–}5\times10^{13}$ | 160 ± 25 | 40–26 |

In the case of the dust having a low electric resistance, nearly a 90% dust removal efficiency irrespective of the accumulation thickness at the point of removal. However, in the case of the dust the electric resistance of which is in the order of $10^{13}\Omega$cm and which is difficult to remove, it is seen from Table 1 that controlling the accumulation thickness at the point of removal increases the dust removal efficiency. In the case of Test No. 6, a reverse ionization phenomenon developed locally due to the uneven removal of dust. This had an extremely deteriorating effect on the dust collecting efficiency of the system.

In the electrostatic particle precipitator equipped with the moving collecting electrodes, regulating the layer thickness of the dust accumulation is effective in improving the dust collecting efficiency. To express this more practically, in the case of the dust the average electric resistance of which is as high as $1\times10^{13}\Omega$cm, the removal is to be made when the accumulated dust thickness is less than 100 $\mu$m, preferably less than 60 $\mu$m, or when the particle accumulation is not more than several layers.

The means for varying the point in time when the dust is removed from the collecting electrodes is two part. One part involves the continuous removal of particles at the non-collecting region B. In this case, the moving speed of the collecting electrode is controlled. The other part consists of intermittent removal of the particles and this is accomplished by moving the collecting electrodes intermittently. Althoug the non-collecting region B which is located at the lower part of the casing 10 receives less impact of the gas flow, the re-entrainment into the gas flow of a small amount of removed dust is unavoidable where the particles are extremely fine in size. The dust particles do, however, tend to cohere to each other on the plate electrodes, so that the amount of possible re- entrained dust particles is less when the accumulation thickness of the dust on the electrodes is thicker. The intermittent operation of starting and stopping the movement of the collecting electrodes to time the removal of collected dust so that it occurs a moment before the accumulation thickness of the collected dust reaches the level which may develop a reverse ionization phenomenon increases the overall volume of collected dust. This, in turn, lowers the operation cost of the system over one involving a continuous removal of the dust from the collecting electrodes.

Figure 3:
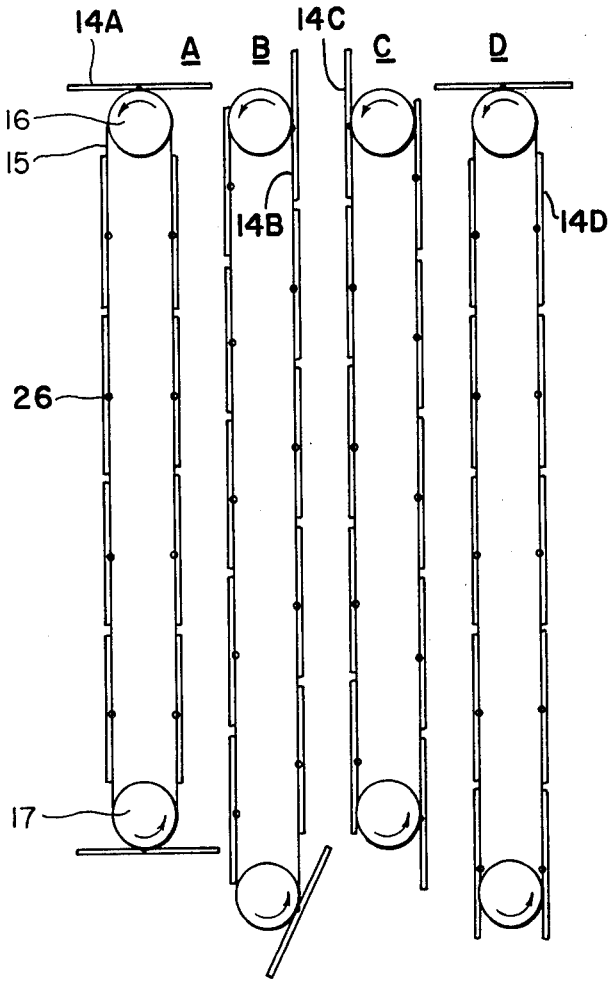
FIG. 3 is a side view showing the relative positions of the collecting electrodes of the electrostatic particle precipitator shown in FIG. 2.

FIG. 3 shows one example of the moving system of the collecting electrodes which can be installed in the electrostatic particle precipitator shown in FIG. 2. The view is looking from the direction of flow of the flue gas, i.e., from left to right with respect to FIG. 2. The collecting electrodes are arranged in parallel adjacent arrays A, B, C and D. The electrodes 14A–14D of each array are of identical dimension and mounted in a loop between the endless chains 15 for movement therewith. These plates are each fixedly attached to individual links of the chains at a mounting point 26 (FIG. 5A) which is disposed along the central longitudinal axis of the plate. Each plate moves rigidly with the chains as they pass between and around the wheels 16 and 17. The plates are equally spaced from each other in the vertical direction between the wheels 16 and 17.

Each of the main driving wheels 16 of each array is installed in the system at the same level with their axes of rotation parallel to each other. The shaft 19 connects all of the wheels 16 to the driving means 20 so that all wheels rotate at the same speed. The subject driving wheels 17 are installed at alternately different levels with their axes of rotation parallel to each other. The difference in the level of mounting of each adjacent wheel 17 equals about one-half the distance between the respective mounting points 26 of adjacent collecting plate electrodes on the endless chains 15.

The collecting plate electrodes 14 are mounted on the endless chains so as to have a phase difference, respectively, toward the rotation of the main driving wheels 16. This phase difference is set at 0.5 $\pi$ against the turning period of the main driving wheels 16. In other words, the plate electrodes 14 in the neighboring vertical arrays are mounted and designed so as to make a turn around the main driving wheels with a delay of 90°. With reference to FIG. 3, the top plate 14A of row A is 90° ahead of the plate 14B of row B as far as their rotation about their respective driving wheels is concerned.

In such a structure, when the main driving wheels 16 rotate in the direction of the arrows shown in FIG. 3 and in synchronization, the endless chains 15, collecting plate electrodes 14 and the wheels 16, 17 are subjected to the same movement and move or turn around in the same direction. As the collecting plate electrodes 14 have a phase difference of 0.5 $\pi$ with relation to their turning period on the main driving wheels 16, they do not come into contact with each other as they move around the main driving wheels 16. Similarly, when they turn around the subject driving wheels 17, the collecting plate electrodes 14 have no possibility of getting in contact with each other, since these wheels are positioned alternately at different levels.

In addition to the above mounting arrangement, the width of each collecting plate electrode 14 is slightly shorter in the locus of its side edges than the distance to the driving wheel in the adjacent array. Thus, for example, as the plate 14B of FIG. 3 rotates about the driving wheel 16 of the array B, it does not contact the periphery of the driving wheel.

Also, as shown in FIG. 4A in the conventional zero phasing system, the collecting electrodes have to be properly spaced and dimensioned in order not to have the locus drawn by the leading and trailing edges of one electrode making contact with the edges of another electrode in the neighboring parallel array as they turn around the main driving wheels 16. In particular the width W of the collecting plate electrode has to be defined in terms of the distance P between the two shafts of the neighboring main driving wheels 16. The relationship has to be such that whatever the position of any collecting plate electrode about one wheel 16, contact with another electrode in an adjacent array is avoided.

The width of the collecting plate electrodes can be greater than W even though the distance P is the same if the electrodes of adjacent arrays are positioned in phased relationship to each other as explained above. The increased width is shown in FIG. 4B at W'. This increased width also permits a reduction in the number of electrode plates in each array and a further simplification of the system. Alternatively, if the width of the electrode is to be kept unchanged, the distance P can be reduced, and correspondingly the dimensions of the whole system can be made smaller.

FIGS. 5A, 5B and 5C show, on an enlarged scale, the edge structure of a plate electrode used in the precipitator of FIG. 2. In particular, the collecting electrode 14 has hexagonal reinforcing frames 27 and 28 at the leading and trailing sides and at both ends, respectively, while at the mid-point of its end, i.e., along the central longitudinal axis of the electrode, a mounting rib 26' is provided. This mounting rib 26' at each end of the electrode is fastened in fixed relation to a modified link of the adjacent endless chain 15 by way of a bolt 30.

The reinforcing frames at the leading and trailing sides help form a non-uniform electric field between the discharge electrodes 18 in the collecting region A. This non-uniform electric field is prone to giving an electric charge to the dust which bears a high electric resistance. This serves to heighten the dust collecting efficiency. To assist in producing this non-uniform electric field the cross sectional profile of the edge part of the reinforcing frames 27 is preferably polygonal and consists of obtuse angles. If, on the other hand, the profile of the edge part were an acute angle, too strong an edge effect becomes the cause of sparking; and if the profile were made almost round in shape, this would tend to make the formation of non-uniform electric field insufficient.

The dust accumulated on the collecting electrodes can be removed by blowing an air jet stream; but it is most practical to scrub off the dust by using a metal wire brush. In FIG. 6, one example of a brush usable in the precipitator of FIG. 2 is shown. One pair of removing brushes is installed with each brush in opposing position, at the same horizontal plane and on opposite sides of the collecting plate electrodes 14. The removing brushes are located in the non collecting region B of the precipitator. The individual brushes are mounted on shafts 31 and 32 and include brush wires 33 and 34 attached to the shafts in a screw pattern. The shafts 31 and 32 are connected to a driving means (not shown in the drawing) by way of the bevel gear, and rotate in directions counter to each other and at the same rotating speed. The distance L between the centers of the two shafts is so adjusted as to have the brush wires 33 and 34 positioned best for scrubbing off the dust from the collecting plate electrodes as they pass between the brushes. Normally the brushes are adjusted so that the tips of the brush wires 33 and 34 touch the collecting plate electrodes 14 over a distance of 10–20 mm. The brush wires 33 and 34 are made of material which has a good resistance to heat, corrosion and wear. The material is also of high elasticity. Stainless steel wire and piano steel wire are suitable. Under certain atmospheres, plastics, such as nylon, or animal bristle can also be used.

If the brush wires 33 and 34 are attached to the shafts 31, 32 in a shape of screw, the contacting points of the wire tips move in a horizontal direction and with a continuous motion across each plate electrode 14 with a fixed pitch while keeping contact with the electrode. Accordingly, the pressing force of the brush wires against the electrodes can be minimized; and as the wires are continuously applied to both sides of the collecting plate electrodes, the latter will be held stable. In addition, the tips of the brush wires slide across the electrodes in a twisting manner while rotating. Therefore, there will be no distortion by wear of the wires and also no deterioration in the function of scrubbing off the dust after extended operation, even if the tips become somewhat worn.

In case the dust contained in the treating flue gas is a mixture of those particles with both low and high electric resistance, it is not advisable from the economics viewpoint to attempt to remove all of such dust with the moving electrode type precipitator. In view of the structural characteristics of this type of precipitator, it is preferable to keep the operating conditions (particularly the moving speed of plate electrodes 14) unchanged throughout the operation. Therefore, in the event that the concentration of the dust contained in the treating flue gas varies from time to time, it is not economical to design a particle precipitator in conformity with the maximum value of concentration.

Figure 7:
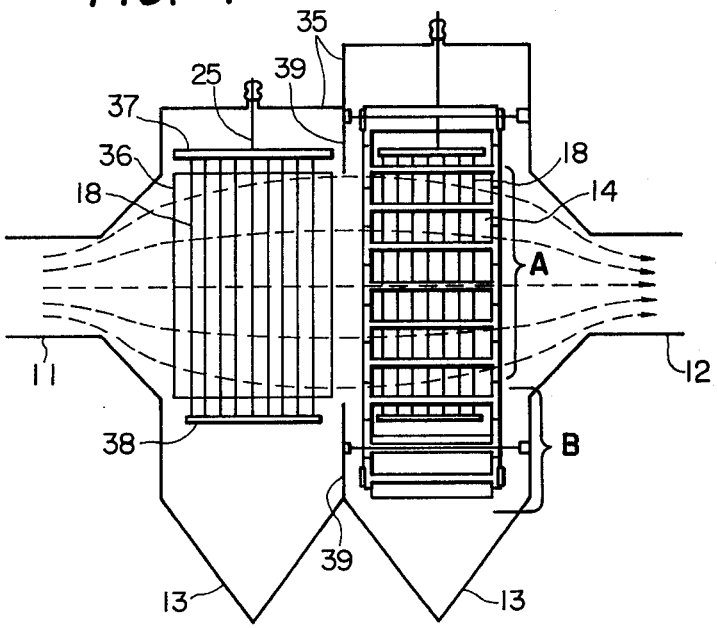
FIG. 7 is a schematic side view showing the example in which the fixed type collecting electrode and the moving type collecting electrodes of the present invention are jointly installed in a casing.

Such a problem as discussed above can be resolved by installing a conventional fixed type precipitator in the front half of the system. This precipitator will remove the dust, as for example, by rapping or otherwise vibrating the plate collectors. In the rear half of the system the moving electrode type electrostatic particle precipitator of the present invention is installed with the two precipitators being connected by a duct. If both of the precipitators are housed in one casing 35 as shown in FIG. 7, the flue gas stream which is formed and rectified while passing through the front precipitator of the fixed type is fed directly into the rear precipitator of the present invention. In this way eddy currents, channelling and turbulence that would otherwise tend to generate around an inlet to the rear precipitator are minimized, and thereby the dust removal efficiency can is improved.

In FIG. 7, the casing 35 provides a gas inlet duct 11 at one end and the gas outlet duct 12 at the other end. A conventional fixed type precipitator is installed on the inlet or front side of the casing 35 and the movable type precipitator on the outlet or rear side of the casing in continuation or series with the front precipitator. The front precipitator includes a plurality of the fixed plate collecting electrodes 36. These electrodes are positioned with a fixed distance between each of them and are oriented in a parallel relation to the direction of flow of the treating flue gas through the casing 35 so that their surfaces face perpendicular to the flow. A plurality of linear shaped discharge electrodes 18 are positioned between the collecting electrodes 36. The upper ends of the discharge electrodes 18 are held by the discharge electrode holder 37. This holder 37 is connected to the bus 25 of the power source. A weight 38 is attached to the lower ends of the discharge electrodes 18 to keep them under strain. Finally, a hopper 13 is installed under the front part of the casing.

A frame shape partition plate 39 is positioned in region B and in the region above region A at the midpoint between the front precipitator and the rear precipitator in order to rectify the flue gas stream. The rear precipitator includes a plurality of the moving electrode type collecting electrodes 14. They are arrayed in paralled relation to the direction of flow of the treating flue gas with a fixed distance between each other and with their collecting surfaces facing perpendicular to the flow. A plurality of the linear shaped discharge electrodes 18 are positioned between the collecting electrodes 14. The treating flue gas passes through the collecting region A of the rear precipitator in a rectified condition as shown by the broken arrows. This construction facilitates a stable and efficient dust collecting operation in the rear precipitator.

Figure 8:
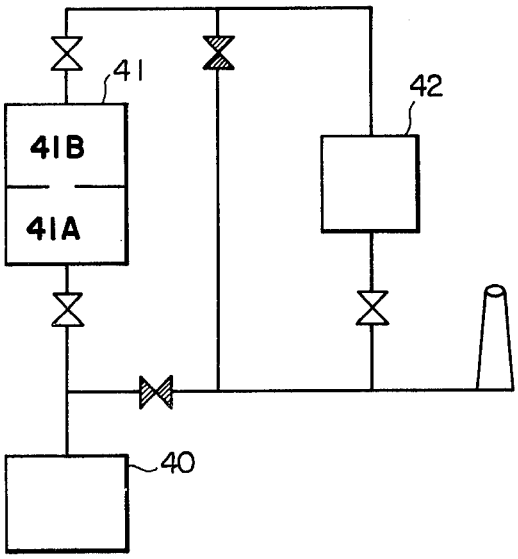
FIG. 8 is a layout chart showing the example wherein the electrostatic particle precipitator of the present invention is applied to the full-scale particle collecting system.

FIG. 8 is a layout chart showing the electrostatic particle precipitator of the present invention as applied to a full-scale particle precipitating system. From the dust generating source 40, a gas of 210° C. is generated with a generating volume of 99,000 $m^3N$ per hour. The dust content in the flue gas is $250\pm29$ $mg/m^3N$ and its composition is alumina 28–30 wt %, silica 68–70 wt %, carbon 0.3 wt % and other ingredients 0.1 wt %. Its apparent electric resistance is $8\text{–}17\times10^{13}\Omega cm$.

The primary electrostatic particle precipitator 41 is a conventional fixed type using a rapping system for removing the dust. The collecting electrodes in a first region 41A of this unit have a dimension of 900 $m^2$ with an applied voltage of 22 kV and the discharge current of 400 mA, while the collecting electrodes in a second region 41B have a dimension of 900 $m^2$ with the applied voltage of 25 kV and the discharge current of 600 mA.

Figure 9:
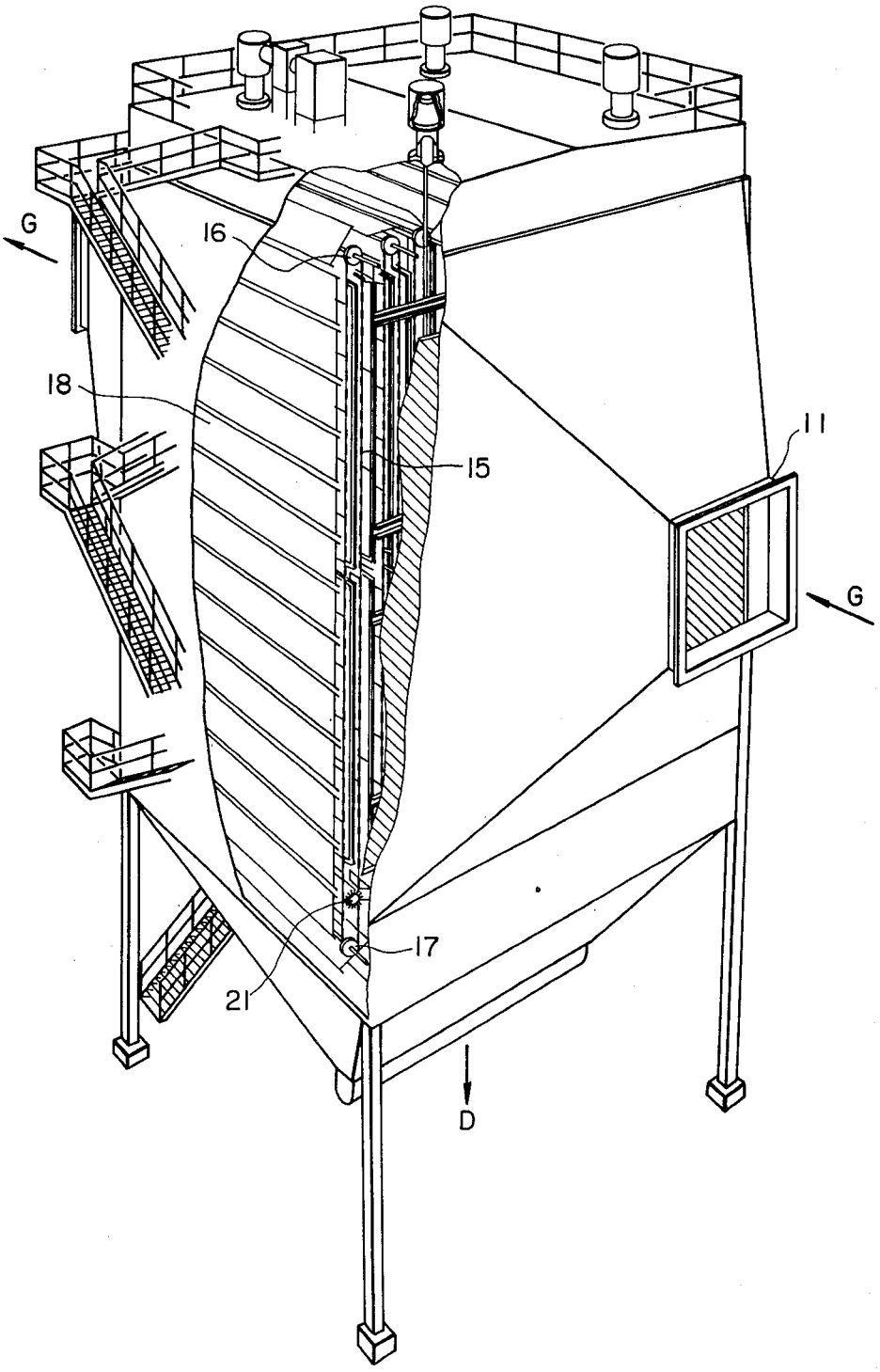
FIG. 9 is the perspective view of the full-scale particle collecting system which is shown in FIG. 8.

The secondary electrostatic particle precipitator 42 is constructed in accordance with the teachings of the present invention with moving collecting electrodes. An outside view of this precipitator is shown in FIG. 9. The temperature of the inlet gas of the secondary precipitator 42 is 200° C., while that of the outlet gas is 190° C. One set of collecting electrodes consisting of eight vertical arrays in side by side relationship is employed. Its total surface area measures 750 $m^2$. Its applied voltage is 45 kV and its discharge current is 600 mA. The moving speed of the electrodes is 0.5 m/min. The dust removing operation using brush unit 21 is performed in the non-collecting region B at the rate of once every 50 min. The designed layer thickness of the accumulated dust is $20\pm10$ $\mu m$.

The result of a 50-day continuous test with the system shown in the layout chart of FIG. 8 is set out in Table 2.

TABLE 2

| Operation Days | Dust Volume at Outlet of Primary Precipitator ($mg./m^3N$) | Dust Volume at Outlet of Secondary Precipitator ($mg/m^3N$) |
|---|---|---|
| Preliminary Test 1 | 105 | — |
| Preliminary Test 2 | 50 | — |
| 3 Days | 120 | 28 |
| 10 Days | 108 | 22 |
| 20 Days | 98 | 18 |
| 30 Days | 92 | 21 |
| 40 Days | 80 | 14 |
| 50 Days | 90 | 16 |

In Table 2, the data for the preliminary Test 1 represent the case where the operation was made with the full volume of flue gas, whereas the data for the preliminary Test 2 present the case where half a volume of flue gas from the dust generating source was discharged directly from the stack into the atmosphere and the volume to the primary electrostatic particle precipitator was thereby reduced to a half.

As shown in Table 2, it is possible, when using the electrostatic particle precipitator of the present invention, to remove a substantial portion of the dust that was not removed by the conventional particle precipitating system. Not only does the electrostatic particle precipitator of the present invention exhibit an outstandingly high dust removing capability when treating flue gas that contains dust which is difficult to remove, the dimension of the precipitator can be made compact. A structure of half or a quarter the size of conventional equipment can give the same performance. This effectively contributes to the ability to locate the system in areas where space is at a premium.

What is claimed is:

1. An electrostatic particle precipitator for removing dust particles from a flue gas moving along a predetermined path, at least a portion of said dust particles having an electric resistance of at least $10^{13}\Omega cm$, said precipitator comprising:

(a) a casing having:
  (1) an inlet for receiving a flue gas,
  (2) an outlet for exhausting a flue gas from the casing after passing therethrough,
  (3) a first region disposed in direct alignment of gas flow between said inlet and outlet, and
  (4) a second region disposed out of direct alignment with the gas flow between said inlet and outlet;

(b) a plurality of rows of dust collecting plate electrodes disposed within said casing for movement alternately and repeatedly through said first and second regions, said plates being oriented with their surfaces facing perpendicular to the flow of gas between said inlet and outlet;

(c) a plurality of discharge electrodes disposed between said rows of collecting electrodes;

(d) means for applying a voltage between said discharge electrodes and collecting electrodes in said first region to cause the electrostatic precipitation of said dust onto said collecting electrodes;

(e) dust removing mean disposed in said second region for removing accumulated dust from said collecting electrodes; and (f) control means for controlling the speed of movement of the collecting electrodes through said regions relative to the rate of removal of dust effected by the dust removing means for maintaining the accumulated layer thickness of dust on said collecting electrodes at a level at which the electric intensity gradient in the accumulated layer is below that at which a reverse ionization zone is generated inhibiting further accumulation of said dust with an electric resistance of at least $10^{13}\Omega$cm on said collecting plates.

2. The precipitator according to claim 1 wherein:

(a) the control means is constructed such that the layer thickness of accumulated dust on said collecting electrodes is at a level at which the electric intensity gradient therein is below about 10 kVcm.

3. The precipitator according to claim 2 wherein:

(a) the control means is constructed such that the layer thickness of accumulated dust on said collecting electrodes is at a thickness of less than 100 $\mu$m.

4. The precipitator according to claim 2 wherein:

(a) the control means is constructed such that the layer thickness of accumulated dust on said collecting electrodes is at a thickness between about 20 and 60 $\mu$m.

5. The precipitator according to claim 2 wherein:

(a) the leading and trailing edges of the plate electrodes are mounted in frames having a cross-sectional polygonal shape with the adjacent sides of the polygon joining each other at obtuse angles.

6. The precipitator according to any one of claims 1-5 further comprising:

(a) mounting means for mounting said collecting plate electrodes in a plurality of parallel arrays, each array being comprised of a continuous loop of moving electrodes defining two of said rows and each array being spaced from the adjacent array by a distance less than the width of the electrodes as measured in their direction of movement along said loop;

(b) said electrodes being fixed to said mounting means, centrally of their width, against relative rotation with respect thereto and for pivoting movement about the ends of the loop as they pass therearound;

(c) said loops, at least at one end thereof, being at the same level; and (d) said electrodes of one array being oriented relative to those of an adjacent array so as to move at a phase difference of 0.5 $\pi$ with respect to each other at about said at least one end of the loop.

7. The precipitator according to any one of claims 1-5 further comprising:

(a) a fixed plate electrostatic precipitator mounted in the casing in the first region thereof between the inlet and the first mentioned precipitator with the moving electrodes, said fixed plate precipitator having:

(1) a plurality of rows of dust collecting fixed plate electrodes oriented with their surfaces facing perpendicular to the flow of gas between the inlet and outlet of said casing, (2) a plurality of discharge electrodes disposed between said rows of collecting electrodes, and (3) means for applying a voltage between said discharge electrodes and collecting electrodes to cause the electrostatic precipitation of said dust onto said collecting electrodes.

8. The precipitator according to claim 7 further comprising:

(a) a partition positioned and arranged between the two precipitators so as to concentrate the flow of gas into said first region as it flows through both of said precipitators.

9. The precipitator according to claim 8 wherein:

(a) the collecting electrodes of the fixed plate precipitator are arranged into two sections disposed along said flow of gas with a first upstream section having a total surface dimension of 900m$^2$ for receiving an applied voltage of 22 kV and discharge current of 400 mA and with the second downstream section having a total surface dimension of 900m$^2$ for receiving an applied voltage of 25 kV and discharge current of 600 mA; and (b) the collecting electrodes of the moving plate precipitator have a total surface dimension of 750m$^2$ with an applied voltage of 45 kV and discharge current to 600 mA.

* * * * *